US006394687B1

(12) United States Patent
Lee

(10) Patent No.: US 6,394,687 B1
(45) Date of Patent: May 28, 2002

(54) ROTATING SHAFT UNIT WITH TWO SHAFT SECTIONS WHICH CAN BE LOCATED SELECTIVELY AT A RELATIVE ANGULAR POSITION

(75) Inventor: Cheng-Tsai Lee, Taipei (TW)

(73) Assignee: Mitac International Corp., Hsinchu (TW)

( * ) Notice: Subject to any disclaimer, the term of this patent is extended or adjusted under 35 U.S.C. 154(b) by 0 days.

(21) Appl. No.: 09/342,498

(22) Filed: Jun. 29, 1999

(51) Int. Cl.[7] ..... A47G 1/24

(52) U.S. Cl. ..... 403/96; 403/322.1; 403/92; 403/97

(58) Field of Search ..... 403/97, 92, 93, 403/94, 96, 321, 322.1, 324; 16/324, 327, 326

(56) References Cited

U.S. PATENT DOCUMENTS 4,186,905 A * 2/1980 Brudy ..... 248/478
4,692,049 A * 9/1987 Engle ..... 403/324 X
5,464,083 A * 11/1995 Arnold et al. ..... 192/223.4
5,520,474 A * 5/1996 Liu ..... 403/97
6,148,480 A * 11/2000 Cooke ..... 16/324 X
6,154,925 A * 12/2000 Miura ..... 16/338

* cited by examiner

*Primary Examiner*—Lynne H. Browne
*Assistant Examiner*—John R. Cottlngham
(74) *Attorney, Agent, or Firm*—Ladas & Parry

(57) ABSTRACT

A rotating shaft unit includes a first shaft section with a first sleeve adapted to be fixed on the first object, and a second shaft section with a second sleeve fixed on a second object. A fixed plug is secured within the first sleeve. A movable plug is disposed axially and movably within the second sleeve. Each of the fixed and the movable plugs has an integral annular tooth unit. A radial push rod extends movably into the first sleeve and the fixed plug, and is biased to move outward in the first sleeve and the fixed plug. An axial push rod is fixed on the movable plug, extends movable through the fixed plug and the first sleeve, and is biased to an extended position, in which the annular tooth units engage each other to secure relative angular position of the fixed and movable plugs.

4 Claims, 4 Drawing Sheets

ROTATING SHAFT UNIT WITH TWO SHAFT SECTIONS WHICH CAN BE LOCATED SELECTIVELY AT A RELATIVE ANGULAR POSITION

BACKGROUND OF THE INVENTION

1. Field of the Invention

This invention relates to a rotating shaft unit, more particularly to a rotating shaft unit having two shaft sections, which can be located selectively at a relative angular position.

2. Description of the Related Art

Referring to FIG. 1, a conventional rotating shaft unit 1, which is used to interconnect a keyboard unit (not shown) and a monitor unit (not shown) of a portable computer (not shown), is shown. The conventional rotating shaft 1 includes a first shaft section (1A) and a second shaft section (1B). The first shaft section (1A) includes an internally splined first sleeve 11 and a first plug 13, which has an outer end surface that is formed with a cylindrical axial bore 131. The first plug 13 is externally splined to engage fittingly the first sleeve 11, thereby preventing rotation of the first plug 13 within the first sleeve 11 while permitting axial movement of the first plug 13 within the first sleeve 11. A right coupler plate 16 is fixed on the first sleeve 11, and has a mounting portion 161, which is adapted to be coupled with the keyboard unit (not shown). The second shaft section (1B) includes an internally splined second sleeve 12 and a second plug 14, which is externally splined to engage fittingly the second sleeve 12. Similarly, the second plug 14 can move axially but is not rotatable within the second sleeve 12. The second plug 14 has an end surface, which is formed with a bore 141, in which a spring 142 is disposed between the second plug 14 and a left end wall of the second sleeve 12. The second plug 14 further has an integral tongue 143, which extends movably into the bore 131 in the first plug 13. A left coupler plate 17 is fixed on the second sleeve 12, and is adapted to be coupled with the monitor unit (not shown). The first and second plugs 13, 14 are formed respectively and integrally with opposed annular tooth units 15. The spring 142 is in a compressed state to engage the annular tooth units 15 so as to prevent relative rotation of the first and second plugs 13, 14, thereby positioning the monitor unit (not shown) relative to the keyboard unit (not shown). The first and second plugs 13, 14 can be disengaged forcibly from each other to permit rotation of the monitor unit (not shown) relative to the keyboard unit (not shown). When it is desired to adjust the position of the monitor unit (not shown) relative to the keyboard unit (not a shown), the operator must force the annular tooth units 15 to disengage upon rotation of the monitor unit (not shown) relative to the keyboard unit (not shown), thereby resulting in energy consumption and inconvenience during the adjustment process.

SUMMARY OF THE INVENTION

The object of this invention is to provide a rotating shaft unit in which the relative angular position of two interconnected shaft sections can be adjusted easily in an energy-saving manner.

According to this invention, a rotating shaft unit is adapted to interconnect a first object and a second object. The rotating shaft unit includes a first shaft section with a first sleeve adapted to be fixed on the first object, and a second shaft section with a second sleeve adapted to be fixed on the second object. A fixed plug is secured within the first sleeve. A movable plug is disposed axially and movably within the second sleeve. Each of the fixed plug and the movable plug has an integral annular tooth unit. A radial push rod extends movably into the first sleeve and the fixed plug, and is located at a retracted position. A radial resilient element biases the radial push rod to move outwardly in the first sleeve and the fixed plug. An axial push rod is fixed on the movable plug, and extends movably through the fixed plug and the first sleeve. An axial resilient element biases the axial push rod to an extended position, in which the annular tooth units engage each other to secure relative angular position of the fixed plug and the movable plug. When the axial push rod is pressed to a retracted position, the radial push rod is biased by the radial resilient element to an extended position. At this time, the radial push rod is located so as to prevent the axial push rod from axial movement in the first sleeve, thereby disengaging the annular tooth units from each other. As such, the first object can be rotated relative to the second object. After the first object is rotated to a selected position relative to the second object, the radial push rod is pressed to the retracted position so as to return the axial push rod to the extended position by the action of the axial resilient element, thereby engaging the annular tooth units. Accordingly, the relative angular position of the first and second objects can be adjusted easily in an energy-saving manner.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
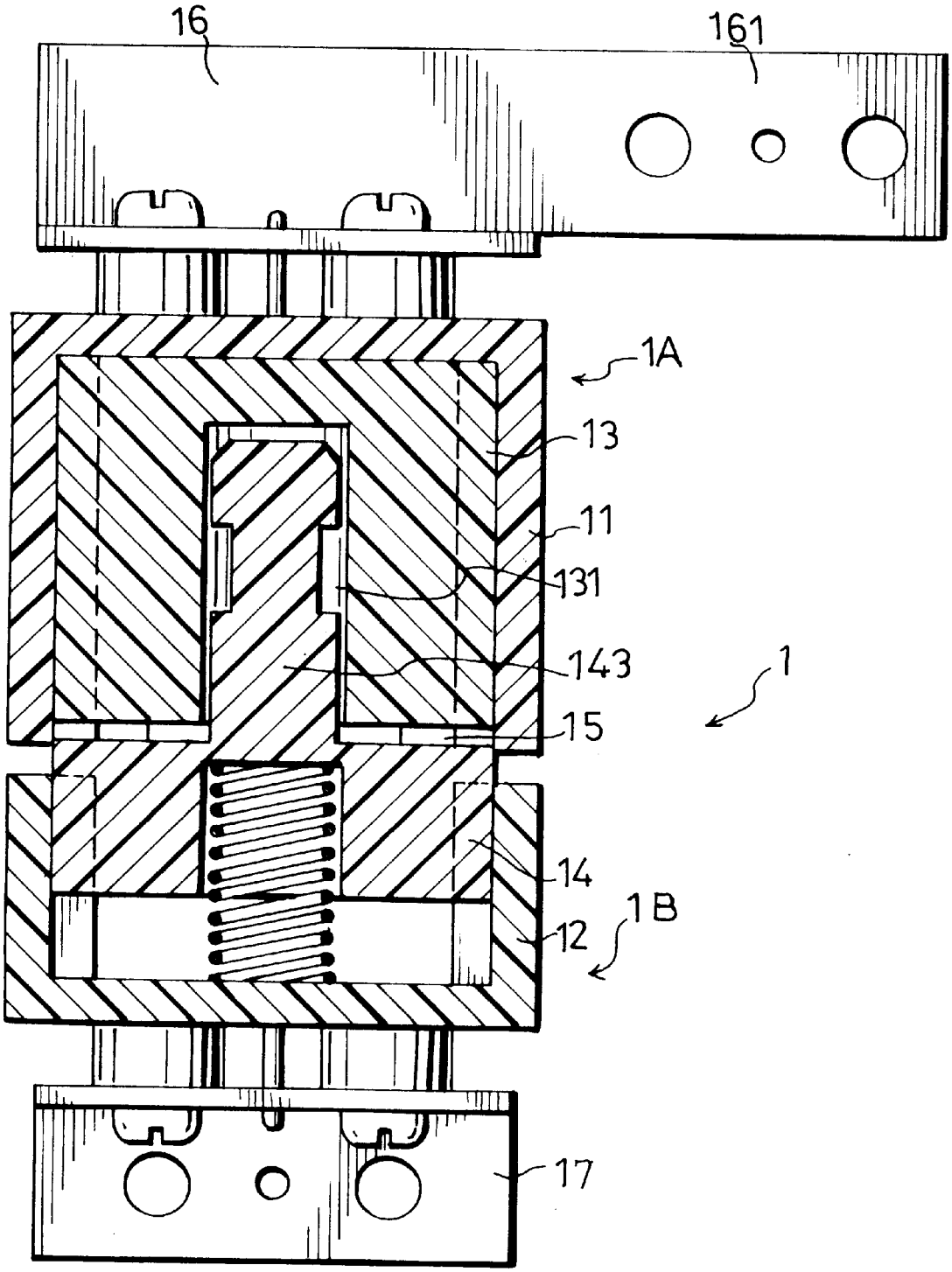
FIG. 1 PRIOR ART
FIG. 1 is a partly sectional top view of a conventional rotating shaft unit.
Figure 2:
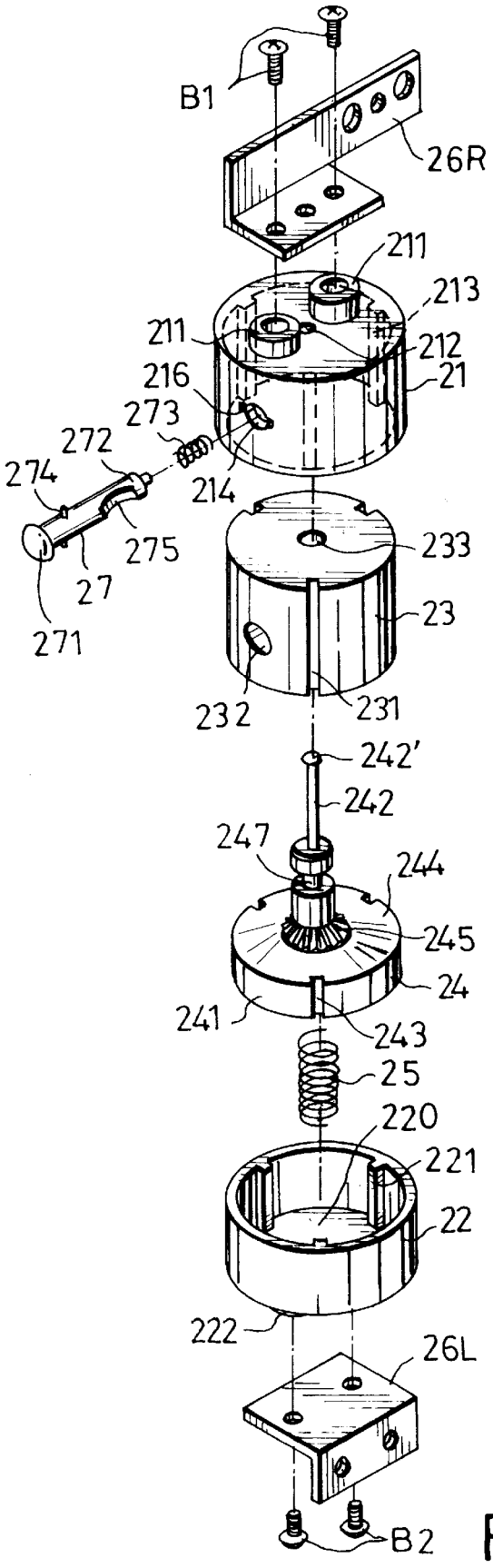
FIG. 2 is an exploded perspective view of the preferred embodiment of a rotating shaft unit according to this invention.
Figure 3:
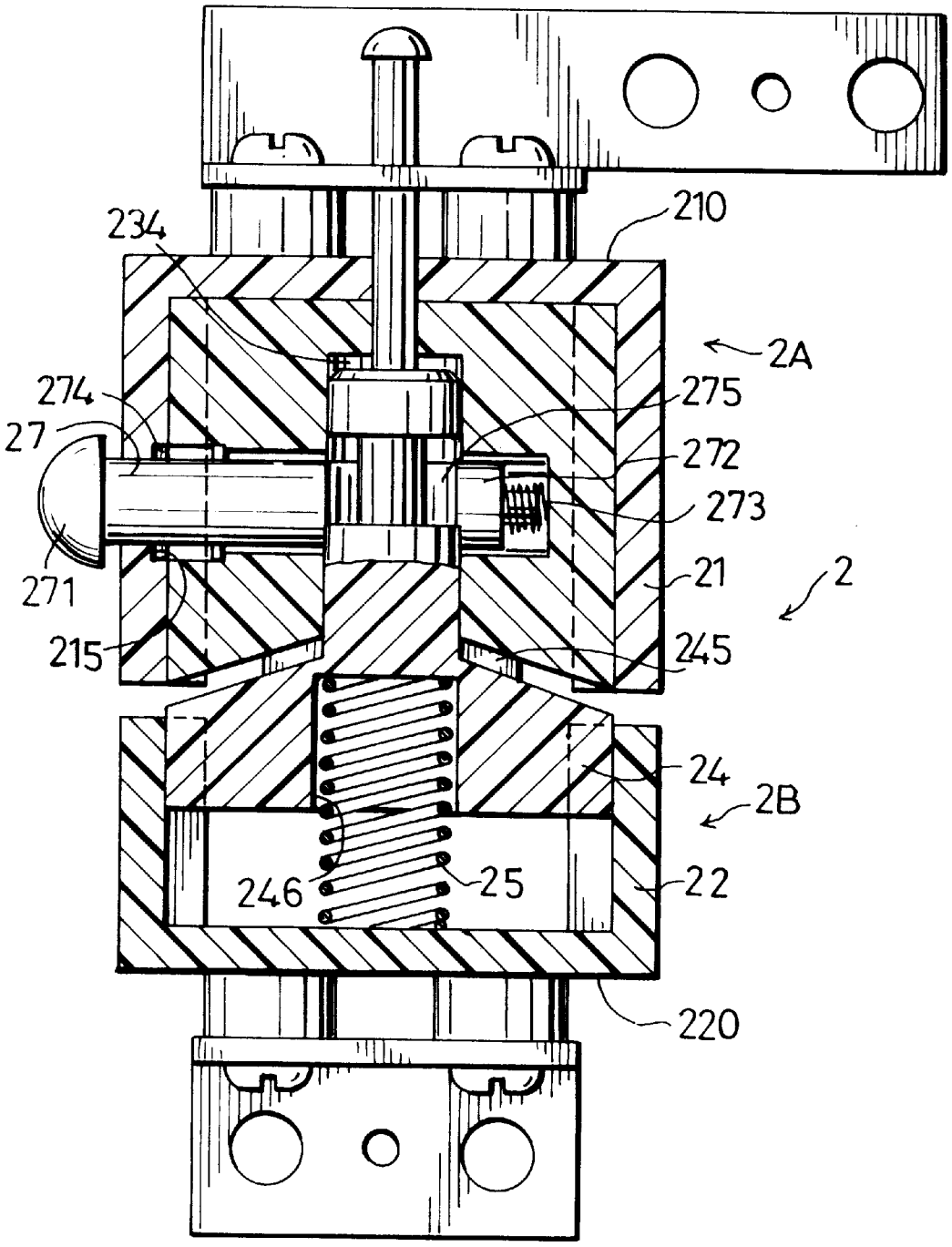
FIG. 3 is a sectional top view of the preferred embodiment, in which two annular tooth units engage each other so that the relative angular position of two shaft sections is not adjustable.

Referring to FIGS. 2 and 3, a preferred embodiment of a rotating shaft 2 according to this invention is shown to include a first shaft section (2A) and a second shaft section (2B). The first shaft section (2A) includes a first sleeve 21, a fixed plug 23, a right coupler plate (26R), and a radial push rod 27. The second shaft section (2B) includes a second sleeve 22, a movable plug 24, an axial resilient element 25, and a left coupler plate (26L).

The first sleeve 21 is shaped as a hollow cylinder, which has a right end wall 210 that is formed with two internally threaded cylinders 211 and a central hole 212. Three angularly equidistant axial ribs 213 are formed integrally on an inner surface of the first sleeve 21. A counterbore 214 is formed through a wall of the first sleeve 21, and has a large-diameter section and a small-diameter section, between which a shoulder 215 is defined. The small-diameter section of the counterbore 214 has two aligned extensions 216, which are located on two sides thereof and which are communicated with the large diameter section.

The right coupler plate (26R) is fixed on the cylinders 211 of the first sleeve 21 by means of a pair of bolts (B1), and is adapted to be coupled with a first object.

The fixed plug 23 is received fittingly within the first sleeve 21, and has an outer peripheral surface formed with three axial slots 231, a radial bore 232, a central hole 233 formed in an inner end surface, an axial bore 234 formed in a concave outer end surface 235, and a first annular tooth unit 236 (see FIG. 4), which is formed integrally on the outer end surface 235 and which is located around the axial bore 234.

The radial push rod 27 has a rounded outer end 271, a stop portion 272 located at an inner end portion thereof, two retaining tongues 274, which project respectively, integrally and outwardly from two sides thereof, and a notch 275 for defining the stop portion 272. A radial resilient element 273 is shaped as a coiled compression spring, and biases the radial push rod 27 to move outward relative to the first sleeve 21. In assembly, the radial push rod 27 is inserted into the counterbore 214 in the first sleeve 21 in such a manner that the retaining tongues 274 of the radial push rod 27 pass respectively through the extensions 216 of the counterbore 214.

Because the ribs 213 of the first sleeve 21 engage respectively the slots 231 in the fixed plug 23, and the radial push rod 27 extends through the counterbore 214 in the first sleeve 21 and into the radial bore 232 in the fixed plug 23, the fixed plug 23 cannot move and rotate within the first sleeve 21.

The second sleeve 22 is shaped as a hollow cylinder, and has a left end wall 220, three axial ribs 221, and two internally threaded cylinders 222, which are formed integrally on the left end wall 220. The movable plug 24 is disposed within the second sleeve 22, and has a peripheral surface 241, an axial push rod 242 fixed on a convex outer end surface 244, three axial slots 243 formed in the peripheral surface 241, a second annular tooth unit 245 formed integrally on the convex outer end surface 244, an axial bore 246 formed in an inner end surface of the movable plug 24, and an annular groove 247 formed in the axial push rod 242. The axial push rod 242 has an outer end portion 242', which extends from the first sleeve 21.

Because the ribs 221 of the second sleeve 22 engage respectively the slots 243 in the movable plug 24, the movable plug 24 can move axially but is not rotatable within the second sleeve 22.

The axial resilient element 25 is shaped as a coiled compression spring, and is disposed within the axial bore 246 in the movable plug 24 between the movable plug 24 and the left end wall 220 of the second sleeve 22 to bias the annular tooth units 236, 245 to engage each other.

The left coupler plate (26L) is fixed on the cylinders 222 of the second sleeve 22 by means of a pair of bolts (B2), and is adapted to be coupled with a second object, which is a monitor unit (not shown) of a portable computer (not shown) in a case where the first object is a keyboard unit (not shown) of the portable computer (not shown).

Normally, the radial push rod 27 is located at a retracted position, as shown in FIG. 3. In this situation, the notch 275 is aligned with the axial push rod 242, thereby permitting axial movement of the axial push rod 242 in the first sleeve 21. Accordingly, the axial push rod 242 is biased by the axial resilient element 25 to a retracted position, as shown in FIG. 3, in which the annular tooth units 236, 245 engage each other. The axial push rod 242 contacts the stop portion 272 of the radial push rod 27 so as to prevent outward movement of the radial push rod 27, thereby keeping the radial push rod 27 in the retracted position.

Figure 4:
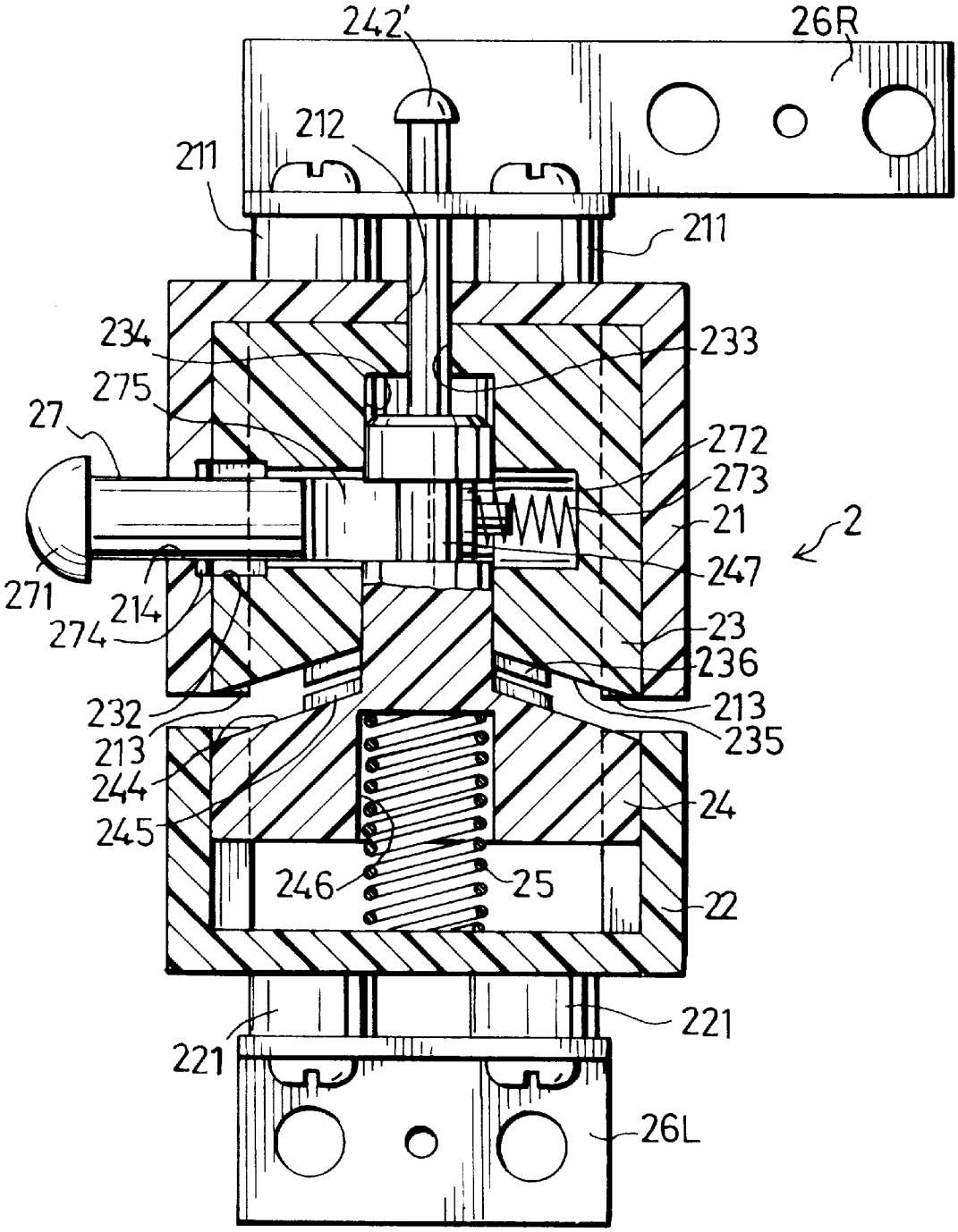
FIG. 4 is a sectional top view of the preferred embodiment, in which the annular tooth units separate from each other so that relative angular position of the shaft sections is adjustable.

When it is desired to rotate the first object relative to the second object, i.e. to change relative angular position of the first and second shaft section (2A, 2B), the outer end portion 242' of the axial push rod 242 is pressed to a retracted position, as shown in FIG. 4, in which the annular tooth units 236, 245 are disengaged from each other. At this time, because the annular groove 247 is aligned with the radial push rod 27, the radial push rod 27 is biased by the radial resilient element 273 to pass through the annular groove 247, and moves to an extended position, as shown in FIG. 4. In this situation, the stop portion 272 of the radial push rod 27 is located within the annular groove 246 to prevent axial movement of the axial push rod 242 within the first sleeve 21. The retaining tongues 274 of the radial push rod 27 abut against the shoulder 215 of the first sleeve 21, thereby preventing removal of the radial push rod 27 from the first sleeve 21. As such, the annular tooth units 236, 245 separate from each other, thereby permitting adjustment of the relative angular position of the first and second shaft sections (2A, 2B).

After adjustment has been finished, the radial push rod 27 is pressed back to the retracted position, as shown in FIG. 3, so as to return the axial push rod 242 to the extended position, as shown in FIG. 3, thereby interengaging the annular tooth units 236, 245.

From the forgoing, it can be understood that the rotating shaft unit 2 can be adjusted easily in an energy-saving manner.

With this invention thus explained, it is apparent that numerous modifications and variations can be made without departing from the spirit and scope of this invention. It is therefore intended that this invention be limited only as indicated in the appended claims.

I claim:

1. A rotating shaft unit interconnecting a first object and a second object, said rotating shaft unit comprising:

a first shaft section including a first sleeve adapted to be fixed on the first object, a fixed plug secured within said first sleeve and having an outer end surface, which is formed integrally with a first annular tooth unit, a radial push rod extending movably into said first sleeve and said fixed plug and located at a retracted position, said radial push rod having a stop portion, means for preventing removal of said radial push rod from said first sleeve, and a radial resilient element for biasing said radial push rod to move outwardly in said first sleeve and said fixed plug; and a second shaft section including a second sleeve adapted to be fixed on the second object, a movable plug disposed axially and movably within said second sleeve and having an outer end surface, which is formed integrally with a second annular tooth unit, an axial push rod fixed on said outer end surface of said movable plug and extending movably through said fixed plug and said first sleeve, said axial push rod having a groove formed therein and an outer end portion, which extends from said first sleeve, said axial push rod being located at an extended position, in which said axial push rod contacts said top portion of said radial push rod to prevent outward movement of said radial push rod against biasing force of said radial resilient element, means for preventing removal of said axial push rod from said first sleeve, and an axial resilient element for biasing said axial push rod to an extended position so as to engage said second annular tooth unit of said movable plug with said first annular tooth unit of said fixed plug, thereby preventing relative rotation of said movable plug and said fixed plug, and thereby securing relative angular position of said first and second shaft sections, said outer end portion of said axial push rod being capable of being pressed inward to a retracted position against biasing force of said axial resilient element, thereby separating said first and second annular tooth units from each other, location of said axial push rod at said retracted position permitting passage of said radial push rod through said groove in said axial push rod by the biasing force of said radial resilient element, thereby moving said radial push rod to an extended position, in which said radial push rod engages said groove in said axial push rod to prevent axial movement of said axial push rod in said first sleeve while permitting rotation of said axial push rod within said fixed plug due to disengagement of said first and second annular tooth units.

2. A rotating shaft unit as claimed in claim 1, wherein said first sleeve has a wall with a counterbore, which is formed through said wall, said counterbore having a large-diameter section and a small-diameter section, between which a shoulder is defined, said radial push rod having two retaining tongues, which project respectively, integrally and outwardly from two sides thereof to press against said shoulder when said radial push rod is located at an extended position, thereby preventing removal of said radial push rod from said first sleeve.

3. A rotating shaft unit as claimed in claim 1, wherein said groove in said axial push rod is annular, and is formed in an outer surface of said axial push rod.

4. A rotating shaft unit as claimed in claim 1, wherein said radial push rod has a notch, which is formed therein to define said stop portion at an end portion thereof, said notch being aligned with said axial push rod upon location of said radial push rod at said retracted position, thereby permitting passage of said axial push rod through said notch in said radial radial push rod upon location of said radial push rod at said retracted position.

* * * * *